US006705697B2

(12) United States Patent
Audi et al.

(10) Patent No.: US 6,705,697 B2
(45) Date of Patent: Mar. 16, 2004

(54) SERIAL DATA INPUT FULL WIDTH ARRAY PRINT BAR METHOD AND APPARATUS

(75) Inventors: Anthony E. Audi, Rochester, NY (US); Juan J. Becerra, Voorheesville, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/091,727

(22) Filed: Mar. 6, 2002

(65) Prior Publication Data

US 2003/0169308 A1 Sep. 11, 2003

(51) Int. Cl.[7] ..... B41J 29/38
(52) U.S. Cl. ..... 347/13; 347/12; 347/42
(58) Field of Search ..... 347/12, 42, 9, 347/211, 13, 128, 162, 237

(56) References Cited

U.S. PATENT DOCUMENTS 5,579,453 A 11/1996 Lindenfelser et al. ..... 395/115
5,617,122 A * 4/1997 Numata et al. ..... 347/14
5,619,622 A 4/1997 Audi et al. ..... 395/108
5,742,321 A * 4/1998 Frederic ..... 347/211
5,959,646 A 9/1999 Bates et al. ..... 347/43
6,027,202 A 2/2000 Narushima ..... 347/10
6,069,710 A 5/2000 Lee ..... 358/1.9
6,089,693 A 7/2000 Drake et al. ..... 347/19
6,135,841 A 10/2000 Mackey ..... 445/52
6,168,251 B1 * 1/2001 Imanaka et al. ..... 347/9
6,234,605 B1 5/2001 Hilton ..... 347/42

* cited by examiner

*Primary Examiner*—Hai Pham
*Assistant Examiner*—Lam S Nguyen
(74) *Attorney, Agent, or Firm*—Maginot, Moore & Beck

(57) ABSTRACT

An arrangement for printing a raster image organized into a plurality of scan lines on a recording medium, the arrangement including a memory and a printbar. The memory contains scan line data representative of said scan lines. The printbar includes a plurality of nozzles and a printbar circuit. The printbar circuit includes an output buffer and a serial data buffer. The serial data buffer is operably connected to receive serially the scan line data such that the serial data buffer includes scan line data corresponding to a first scan line. The output buffer is operably connected to receive the scan line data from the serial data buffer. The printbar circuit is further operable to cause the plurality of nozzles to print on the recording medium in accordance with the scan line data stored in the output buffer.

17 Claims, 8 Drawing Sheets

SERIAL DATA INPUT FULL WIDTH ARRAY PRINT BAR METHOD AND APPARATUS

FIELD OF THE INVENTION

The present invention relates generally to printing devices, and in particular, to printing devices that employ a full width array print bar.

BACKGROUND OF THE INVENTION

An ink jet printer of the type frequently referred to as drop-on-demand, has at least one print head from which droplets of ink are directed towards a recording medium. Within the printhead, the ink is contained in a plurality of channels. Piezoelectric devices or power pulses cause the droplets of ink to be expelled as required, from orifices or nozzles located at the end of the channels. In thermal ink jet printing, the power pulses are usually produced by resistors, also known as heaters, each located in a respective one of the channels.

The heaters are individually addressable to heat and vaporize the ink in the channels. As a voltage is applied across a selected heater, a vapor bubble grows in that particular channel and ink bulges from the channel nozzle. At that stage the bubble begins to collapse. The ink within the channel then retracts and separates from the bulging ink thereby forming a droplet moving in a direction away from the channel nozzle and towards the recording medium whereupon hitting the recording medium a spot is formed. The channel is then refilled by capillary action which, in turn, draws ink from a supply container of liquid ink. Operation of a thermal ink jet printer is described in, for example, U.S. Pat. No. 4,849,774.

The ink jet printhead can be incorporated into a carriage type printer or a page width type printer. A carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles on the printhead) at a time on a stationary recording medium, such as paper or a transparent recording medium. After the swath is printed, the paper is stepped a distance equal to the height of the printed swath or a portion thereof, so that the next printed swath overlaps or abuts therewith. The procedure is repeated until an entire page is printed.

By contrast, the page width printer includes a stationary printbar having a length equal to or greater than the width of the recording medium. The recording medium is continually moved past the page width printbar in a direction substantially normal to the printbar length and at a constant or varying speed during the printing process. Because the printbars have an arrangement of substantially linearly aligned nozzles, the alignment of the printbar with respect to the recording medium is critical.

Printers typically print information received from an image output device such as a general purpose computer. Typically, these output devices generate pages of information in which each page is in the form of a page description language. An electronic subsystem (ESS) in the printer transforms the page description language into a raster scan image which is then transmitted to a peripheral or image output terminal (IOT). The raster scan image includes a series of scan lines in which each scan line contains information sufficient to print a single line of information across a page in a linear fashion. In the page description language, generated pages also include information arranged in scan lines.

In printbars which print a single line of pixels in a burst of several banks of nozzles, each bank printing a segment of a line, the banks of nozzles are typically fired sequentially and the nozzles within a bank are fired simultaneously. An ink jet printbar having banks of nozzles is described in U.S. Pat. No. 5,300,968, which is incorporated herein by reference. These printbars include a plurality of printhead dies, wherein each die prints a portion of a line. Within the die, the banks of nozzles print a segment of the portion of the line.

It will be appreciated that the continuous movement of the recording medium in the process direction would require all of the nozzles to be able to fire simultaneously to assure that the printing of all portions of the line of pixels is collinear. Simultaneous firing of all of the nozzles of page width printbar, however, is impracticable. In particular, such a firing would require too much energy and would generate too much heat. As a result, as a practical matter, the nozzles must be fired sequentially. Because the nozzles fire sequentially, the continuous movement of the recording medium raises an issue with regard to the linear alignment of the printing.

To address this issue, U.S. Pat. No. 5,619,622 teaches, among other things, a full width array printing device that employs an angled printbar. The angled printbar allows sequentially fired nozzles to achieve collinear printing when the recording medium is continuously moving. Because of the angled printbar, each printhead die starts on a new print or scan line. Accordingly, each die prints data corresponding to a different raster line. Because each print die prints on a different raster line, U.S. Pat. No. 5,619,622 teaches a raster interface or wedge buffer that converts full-width raster data to mini-rasters for each print die.

While the solution taught by U.S. Pat. No. 5,619,622 adequately achieves collinear and rapid printing for use with a continuously moving recording medium, that solution requires additional cost associated with the raster data reconfiguration step. Such cost arises from the inclusion of the wedge buffer.

A need exists, therefore, for a page width printer controller that is operable to achieve collinear page width printing for use with a continuously moving recording medium that avoids at least some of the cost associated with reconfiguration of the raster data as described above.

SUMMARY OF THE INVENTION

The present invention fulfills the above needs, as well as others, by providing a method and arrangement for printing data arranged as a plurality of scan lines using a printbar circuit that includes an output buffer and a serial data buffer; the serial data buffer connected to receive the scan line data serially without reconfiguration. The output buffer is connected to receive the scan line data from the serial data buffer. The printbar circuit causes printing in accordance with the scan line data stored in the output buffer. Thus, the scan line data is received into the serial data buffer in scan line format, thereby eliminating the need to reformat the data.

A first embodiment of the present invention is an arrangement for printing a raster image organized into a plurality of scan lines on a recording medium, the arrangement including a memory and a printbar. The memory contains scan line data representative of said scan lines. The printbar includes a plurality of nozzles and a printbar circuit. The printbar circuit includes an output buffer and a serial data buffer. The serial data buffer is operably connected to receive serially the scan line data such that the serial data buffer includes scan line data corresponding to a first scan line. The output buffer is operably connected to receive the scan line data from the serial data buffer. The printbar circuit is further operable to cause the plurality of nozzles to print on the recording medium in accordance with the scan line data stored in the output buffer.

A second embodiment of the present invention is a method for printing a raster image organized into a plurality of scan lines on a recording medium. The method first includes storing scan line data representative of said scan lines in a memory. The scan line data is provided serially to a serial data buffer such that the serial data buffer includes scan line data corresponding to a first scan line. The scan line data is transferred from the serial data buffer to an output buffer. The method also includes causing a plurality of nozzles to print on the recording medium in accordance with the scan line data stored in the output buffer.

The above discussed features and advantages, as well as others, may be readily ascertained by those of ordinary skill in the art by reference to the following detailed description and accompanying drawings.

DETAILED DESCRIPTION

Figure 7:
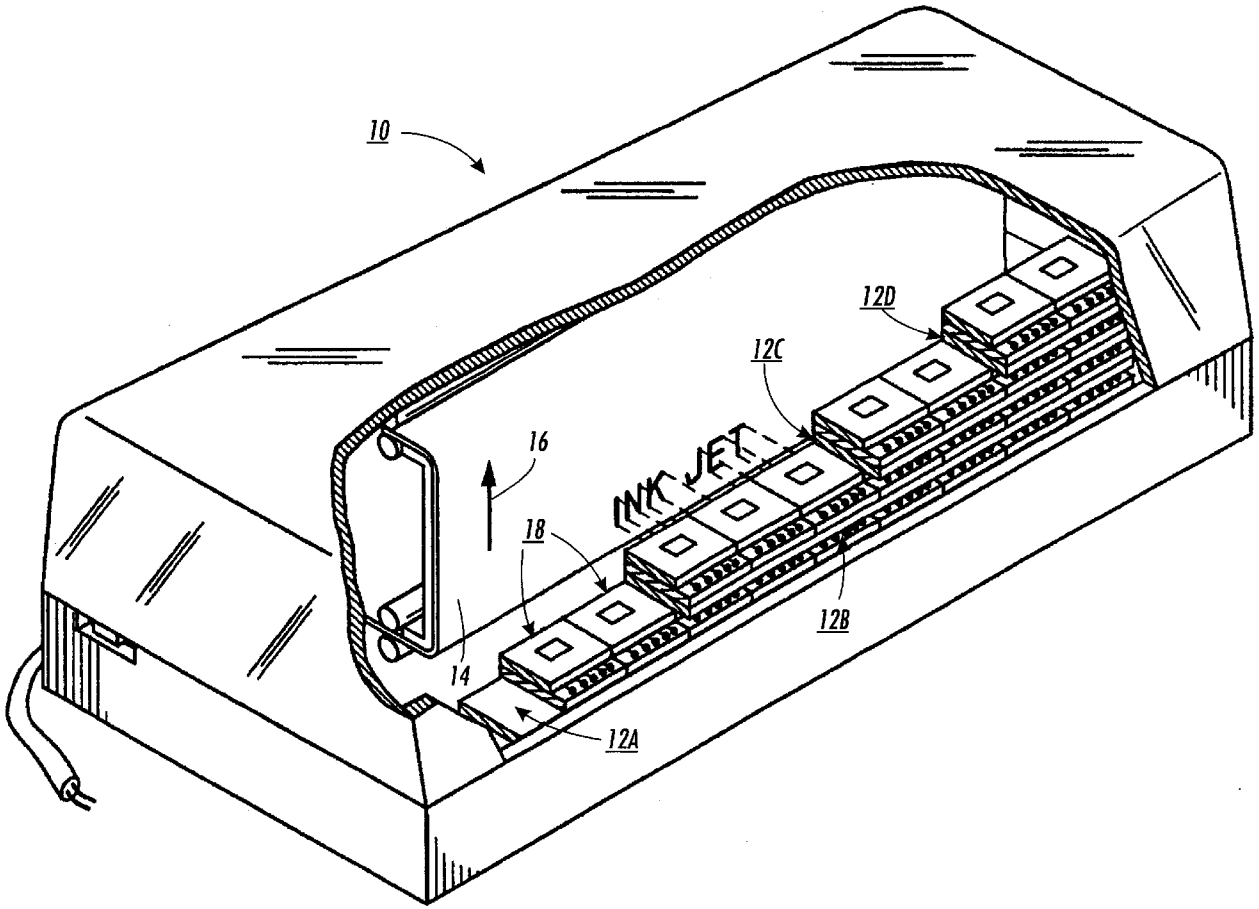
FIG. 7 shows a fragmentary perspective view of a printer utilizing a thermal ink jet printbar for full page width printing.

FIG. 7 is a fragmentary perspective view of a page width type, multi-color, thermal ink jet printer 10. The multi-color printer 10 includes four stationary printbars 12A, 12B, 12C, and 12D. Each of the printbars 12A, 12B, 12C and 12D effectuate printing of one of the plurality of constituent color inks of the multi-color printer 10. For example, the printbars 12A, 12B, 12C and 12D may print, respectively, black, yellow, magenta and cyan color inks. These inks can be combined in various quantities to generate hundreds of color shades and tones as is known in the art. Each of the print bars 12A, 12B, 12C and 12D (hereinafter referred to generically as "12") have a length equal to or greater than the length of a recording medium 14. The recording medium 14 can, for example, be a sheet of paper or a transparent medium.

It will be appreciated, however, that embodiments of the subject invention can alternatively be incorporated into a page width, monochrome thermal ink jet printer by those of ordinary skill in the art. In general, a page width monochrome printer has a single stationary printbar such as 12A, having a length equal to or greater than the length of the recording medium 14.

In any event, the recording medium 14 is continually moved past the page width printbars in the direction of the arrow 16, a direction substantially normal to the printbar length and referred to herein as the process direction. The medium 14 moves at a constant or varying speed during the printing process. Reference is made to U.S. Pat. No. 4,463,359 to Ayata et al. and U.S. Pat. No. 4,829,324 to Drake et al. for examples of page width printing.

The page width printbars 12 are made of an array of individual printhead subunits or dies 18. Any known method may be used to fabricate the individual printhead dies 18. One example is disclosed in U.S. Pat. No. Re. 32,572, which is incorporated herein by reference. In general, printhead subunits are derived from a heater die containing an array of resistors and the associated electronic circuitry and a channel die containing arrays of recesses used as sets of channels ending in nozzles and having associated reservoirs for carrying ink into the channels. Each nozzle and reservoir is associated with a portion of the array of resistors that is referred to herein as the nozzle circuit for that nozzle. The nozzle circuit is operable to cause its corresponding nozzle to fire (dispel ink).

Figure 1:
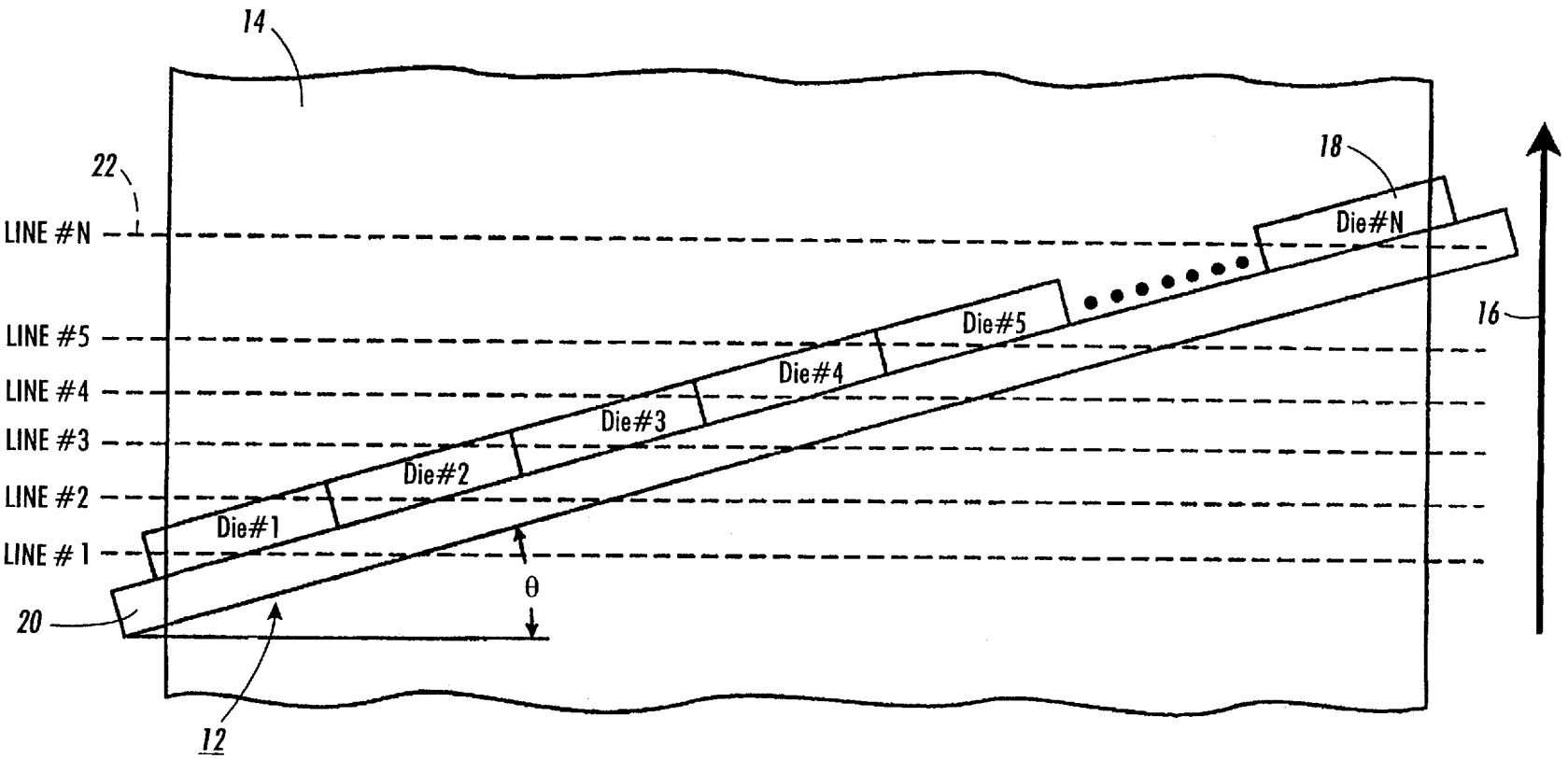
FIG. 1 shows a schematic depiction of a first embodiment of a full width printbar angled with respect to the process direction.

Each individual printbar 12 includes a plurality of the printhead dies 18 butted together into and mounted on a substrate 20 which can be made of a material such as graphite or metal, as illustrated in FIG. 1. Each of the printhead dies 18 include several hundred or more nozzles which are fired sequentially in banks of nozzles. Each bank typically includes between four and eight nozzles. When mounted on the printbar 12, all of the die 18 are fired in parallel for one full printing of the entire printbar 12 and all of the banks within a die are fired sequentially. Thus, the first banks of all of the print dies 18 fire simultaneously, then the second banks of all of the print dies 18 fire simultaneously, and so forth.

Figure 6:
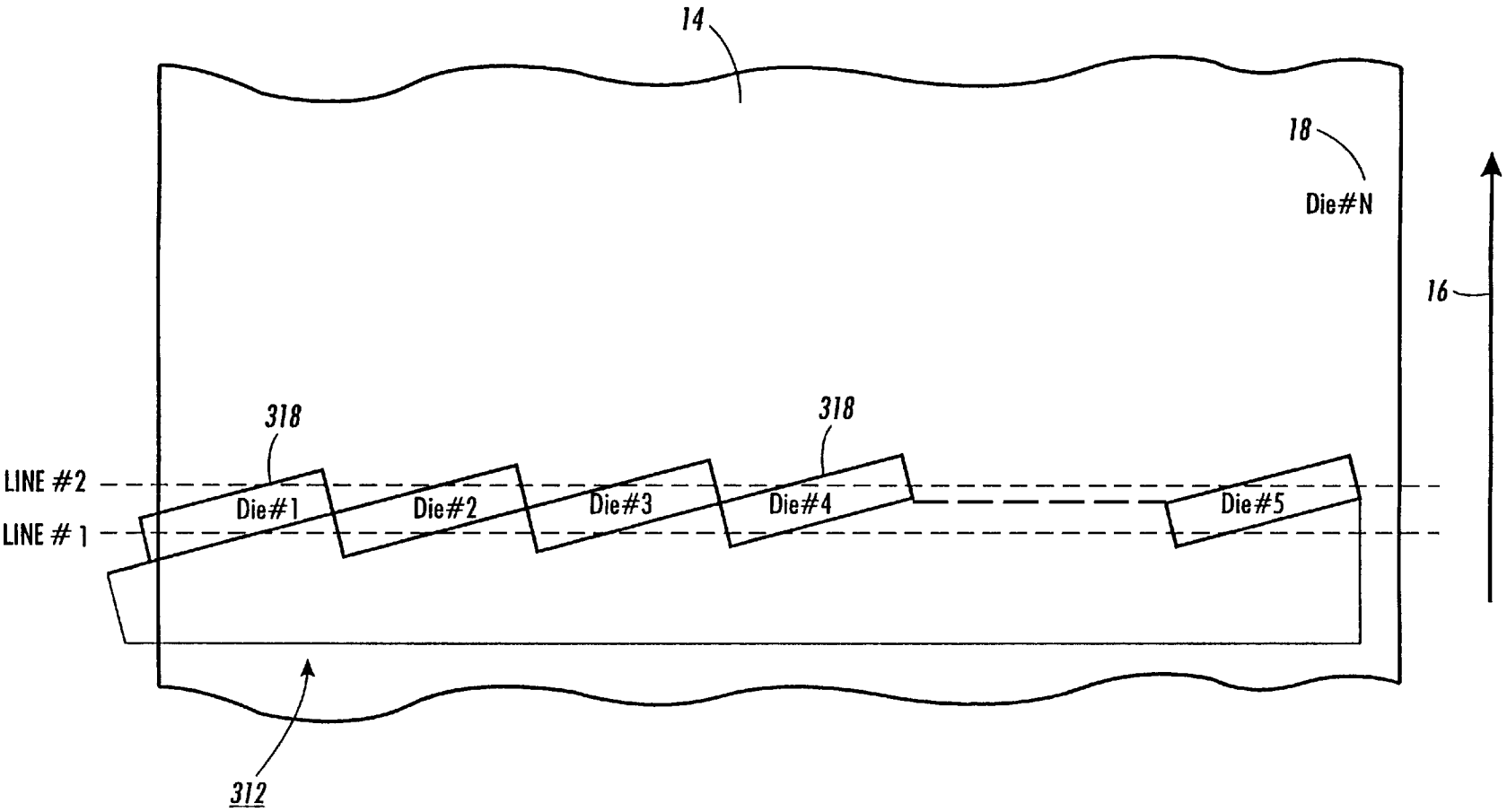
FIG. 6 shows a schematic depiction of a full width printbar having individual print dies that are angled with respect to the process direction.

Due to the finite amount of time necessary to ripple through an entire die, each printhead die 18 must be tilted slightly or angled with respect to the process direction 16 to compensate for the time it takes to ripple through each stroke of a single die. Otherwise, the line portions printed by a die would be angled with respect to the horizontal scan line since the recording medium 14 is in motion. For example, if a die has 256 nozzles which are fired in banks of four nozzles at a time, and each firing lasts 3.2 microseconds, each stroke of the die will take approximately 210 microseconds to complete. To compensate, die are tilted at an angle theta with respect to a horizontal scan line 22 to provide the proper alignment of the ink spots when deposited on the recording medium 14. The angle theta is approximately equal to the size of one ink spot or pixel divided by the length of the printhead die 18. FIG. 6, discussed further below, shows a printbar 312 having individually tilted print dies 318.

Due to manufacturing concerns, however, it is not completely practical to tilt each die individually and to align the entire printbar along a single scan line. Instead, the printhead die are, in the first embodiment described herein, mounted collinearly and the entire printbar 12 is tilted at the angle theta. Accordingly, if there are N die on the printbar 12, then the bar is tilted by N pixels or scan lines, where the height of a scan line is equal to one pixel, so that the tilted printbar extends across N scan lines. As a result, each die 18 prints a portion of a different scan line from the raster image on a different line of the recording medium as illustrated in FIG. 1. For instance, die number one will print on line number one, die number two will print on line number two, and so forth.

Because the printbar 12 does not print along a single line, but instead prints on many lines, the manipulation of data used in the printing operation is not the simple operation of receiving linear data from an ESS and then printing the information as it is received.

However, in accordance with embodiments of the subject invention, the printbar 12 includes a circuit that facilitates receiving printing data as serial scan lines, i.e. without special transformation, and then printing the information on the tilted printbar 12 described above in the sequence described above. It is noted that an alternative arrangement according to embodiments of the subject invention may be employed in a printbar where the individual die are tilted, with the printbar being arranged with no tilt or angle. Such alternative will be discussed further below in connection with FIG. 6.

Figure 2:
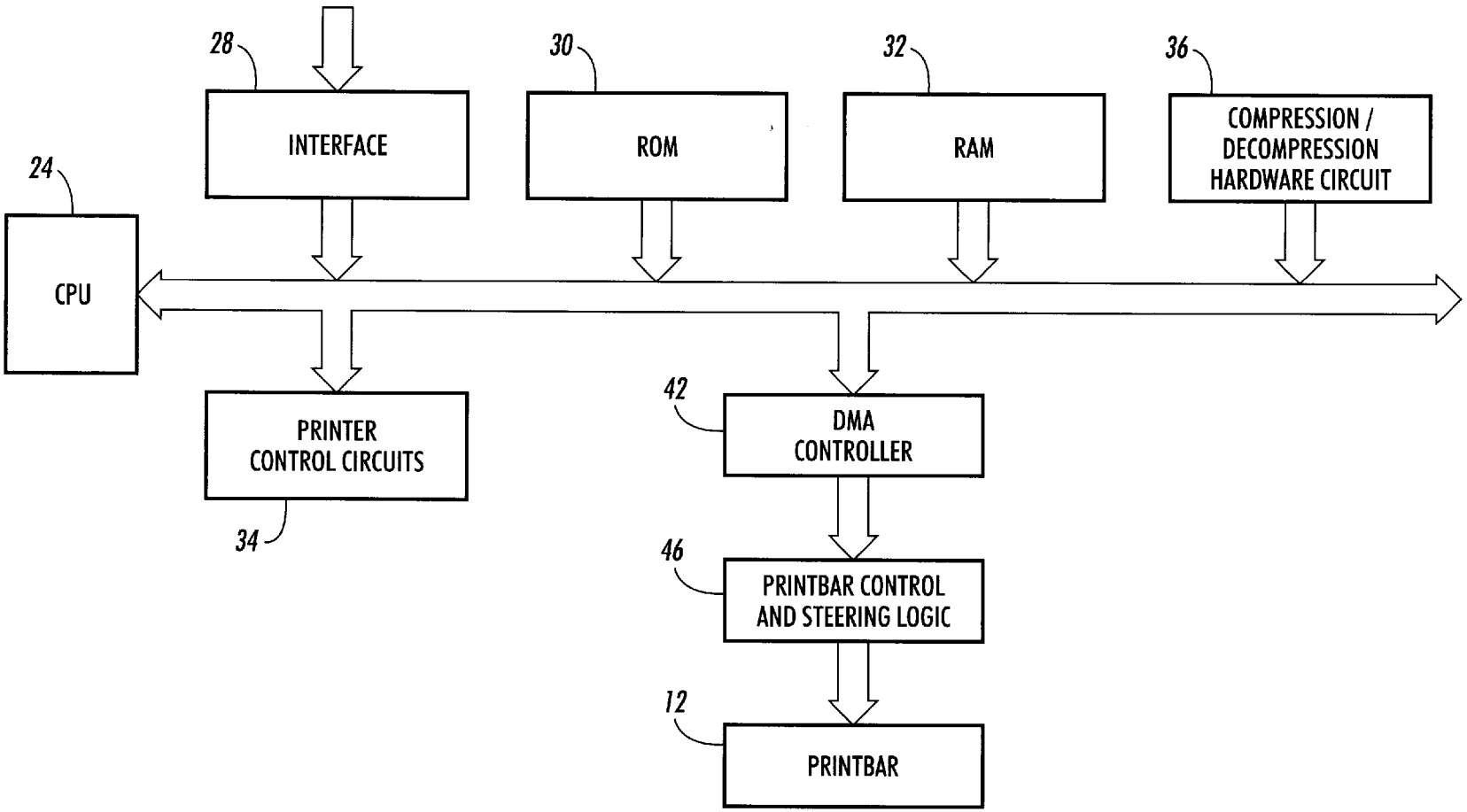
FIG. 2 shows a schematic block diagram of an electronic circuit for an ink jet printer having an arrangement for printing a raster image in accordance with the present invention.

Referring again to the first embodiment described herein, FIG. 2 shows a schematic block diagram of the electronic circuitry in an ink jet printer incorporating at least one embodiment of the subject invention. The electronic circuitry of FIG. 2 includes the elements of the ESS that assists in generating scan line data for use by the printbar 12.

In particular, a central processing unit or CPU 24 is connected through a bus 26 to an interface 28 which, in turn, is connected to an external device such as a host computer. The external device (referred to herein as the exemplary "host computer") provides information in the form of a page description language to the printer 10 for printing. The CPU 24 is also connected to a read only memory (ROM) 30 that includes an operating program for the CPU 24. A random access memory 32 connected to the bus 26 includes accessible memory including print buffers for the manipulation of data and for the storage of printing information in the form of bitmaps received from the host computer. In addition to the ROM 30 and the RAM 32, various printer control circuits are also connected to the bus 26 for operation of the printing apparatus which includes paper feed driver circuits as is known by those skilled in the art. A compression/decompression hardware circuit 36 can also be included in the printer 10 for altering input image data from one form to another received from a host computer for proper printing of the image by the printbar 12.

To print an image, the printbar 12 must print information received from the ESS which may, but need not, be stored in the RAM 32. In the present embodiment, the DMA controller 42 obtains the scan line data and provides it to the printbar 12. This information can be in the form of raster data which is composed of a series of scan lines, each of the scan lines including a number of individual bits. Each bit indicates whether or not a nozzle will fire in a particular scan line. To this end, each nozzle is associated with an output buffer register, as discussed in further detail below in connection with FIG. 3. During each stroke of the printbar 12, each nozzle fires if its corresponding output buffer register contains a "1", and does not fire if its corresponding output buffer register contains a "0".

The information received from the host computer can be in the form of a page description language as is known in the art, and which is converted to raster format data by the ESS of the printer 10 before printing by the printbar 12. Because the printbar 12 prints each of the die simultaneously and each bank within a single die sequentially, the raster data to be printed is provided to the output buffer and nozzle must be configured to accommodate the firing sequence.

In accordance with embodiments of the subject invention, the printbar 12 includes a printbar circuit 102 (see FIG. 3) that allows serial scan line data, e.g. raster data, to be received sequentially in scan line format and then be printed out in a sequence that accommodates the angled printbar 12.

Figure 3:
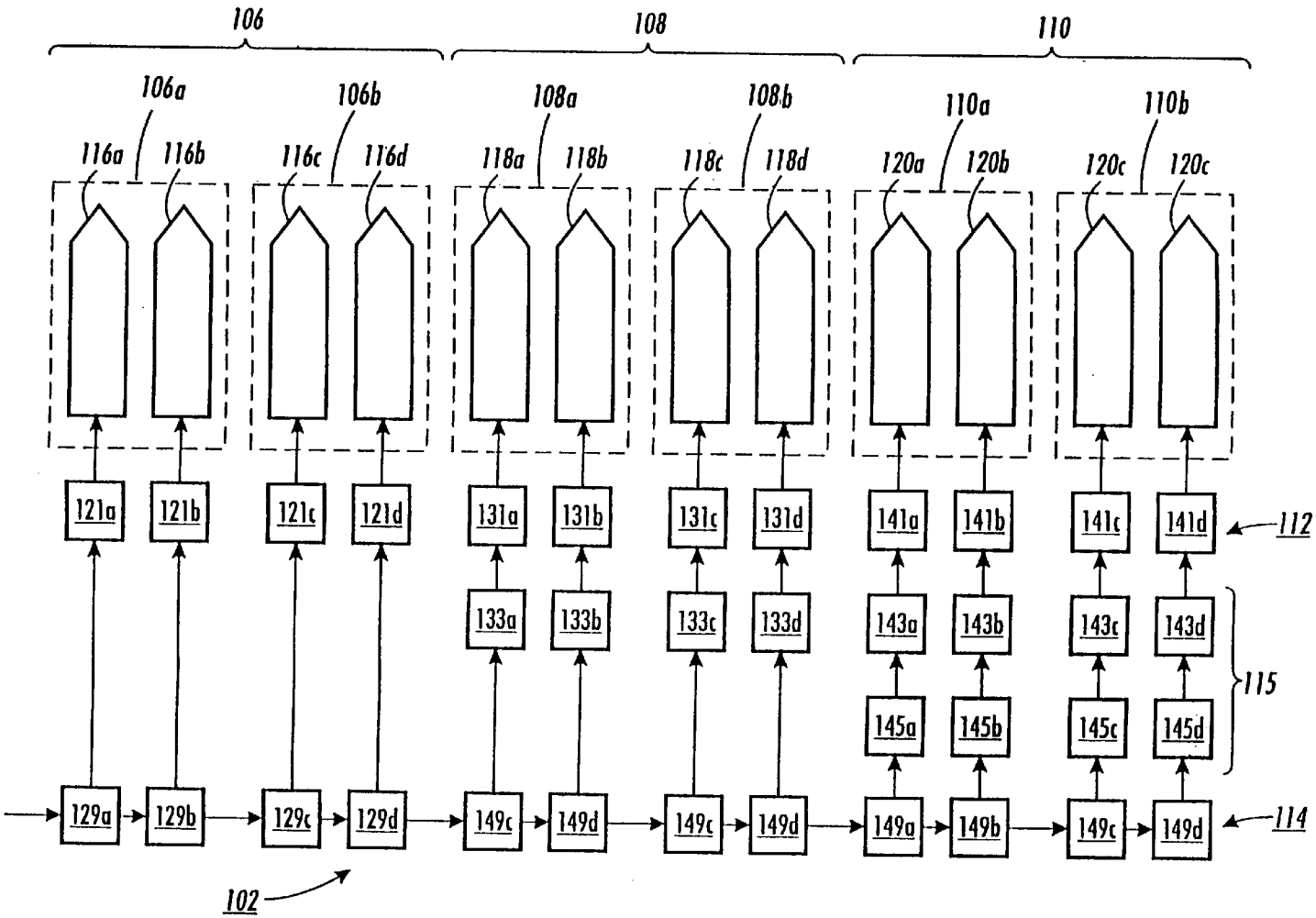
FIG. 3 shows a schematic block diagram of an exemplary embodiment of a printbar circuit according to the present invention.

In particular, FIG. 3 shows a schematic block diagram of an exemplary printbar circuit 102 that can be used in the printbar 12 in accordance with embodiments of the subject invention. For purposes of exposition only, the printbar circuit 102 is configured for a twelve nozzle printbar having three print dies, each print die having two banks of two nozzles. It will be appreciated that the printbar circuit 102 is shown in simplified form for clarity of exposition. The printbar 102 can readily be modified or adapted to more common numbers of nozzles, banks and dies. As discussed further above, an actual page width printbar will include on the order of twenty print die, each having 128 to 256 nozzles in banks of four to eight nozzles per bank.

In any event, the printbar circuit 102 twelve nozzle circuits 116*a*, 116*b*, 116*c*, 116*d*, 118*a*, 118*b*, 118*c*, 118*d*, 120*a*, 120*b*, 120*c* and 120*d*. Each nozzle circuit is a circuit that is operable to receive a bit of digital data and fire an ink nozzle in response to the presence of a certain digital signal. For example, if the nozzle circuit 116*a* receives a one as an input, then the nozzle circuit 116*a* causes its corresponding nozzle to fire. As discussed further above, the nozzle circuit 116*a* use piezoelectric pulses or power pulses to cause the firing. Many suitable types of nozzles circuits would be known to those of ordinary skill in the art.

The twelve nozzle circuits 116*a*–116*d*, 118*a*–118*d*, and 120*a*–120*d* are separated into print die circuits 106, 108 and 110, respectively, such that four nozzle circuits are associated with each print die circuit. Each of the print die circuits 106, 108 and 110 corresponds to one of three print die of the printbar 12.

The print die circuit 106 includes a first bank circuit 106*a* corresponding to nozzle circuits 116*a* and 116*b*, and a second bank circuit 106*b* corresponding to nozzle circuits 116*c* and 116*d*. Similarly, the print die circuit 108 includes a first bank circuit 108*a* corresponding to nozzle circuits 118*a* and 118*b*, and a second bank circuit 108*b* corresponding to nozzle circuits 118*c* and 118*d*. In a similar manner, the print die circuit 110 includes a first bank circuit 110*a* corresponding to nozzle circuits 120*a* and 120*b*, and a second bank circuit 110*b* corresponding to nozzle circuits 120*c* and 120*d*.

The printbar circuit 102 further includes an output buffer 112 and a serial data buffer 114. The output buffer 112 includes registers 121*a*, 121*b*, 121*c*, 121*d*, 131*a*, 131*b*, 131*c*, 131*d*, 141*a*, 141*b*, 141*c* and 141*d*. Each of the output registers 121*a*–121*d* has an output coupled to a respective one of the nozzle circuits 116*a*–116*d*. Likewise, each of the output registers 131*a*–131*d* has an output coupled to a respective one of the nozzle circuits 118*a*–118*d*. Similarly, each of the output registers 141*a*–141*d* has an output coupled to a respective one of the nozzle circuits 120*a*–120*d*.

The serial data buffer 114 includes serially connected data registers 129*a*, 129*b*, 129*c*, 129*d*, 139*a*, 139*b*, 139*c*, 139*d*, 149*a*, 149*b*, 149*c*, and 149*d*. By serially connected, it is meant that the output of each serial data register is coupled to the input of the subsequent register. For example, the output of the serial data register 129*a* is coupled to the input of the serial data register 129*b*. The outputs of the serial data registers 129*a*–129*d* are also connected to, respectively, the inputs of the output registers 121*a*–121*d*. The outputs of the serial data registers 139*a*–139*d* are also connected to, respectively, the inputs of interim registers 133*a*–133*d*. The outputs of the serial data registers 149*a*–149*d* are also connected to, respectively, the inputs of interim registers 145*a*–145*d*.

The outputs of the interim registers 133*a*–133*d* are coupled to, respectively, the inputs of the output registers 131*a*–131*d*. The outputs of the interim registers 145*a*–145*d* are coupled to, respectively, the inputs of the interim registers 143*a*–143*d*. The outputs of the interim registers 143*a*–143*d* are coupled to, respectively, the inputs of the output registers 141*a*–141*d*.

In the exemplary embodiment described herein, the interim registers, which are collectively referred to herein as the interim register array 115, are employed to carry out the translation of the raster or scan line data to the allow the staggered line printing required by the placement of the printbar 12 in an angled alignment as described above.

To this end, the interim array 115 provides an offset between certain output registers and certain serial data registers so that although the data is received as a full raster line, it is printed out in mixed raster format.

In particular, the output register associated with each nozzle is separated from its corresponding serial data buffer register by a number of interim registers that is equal to the line offset of the die in which the nozzle is located with respect to the first die. Thus, for example, the output buffer register 121*b*, which is associated with a nozzle in the first die, is separated from its corresponding serial data buffer register 129*b* by no interim buffers. Because, however, the second die is offset by one scan line from the first die, the output buffer register 131*c*, which is associated with a nozzle in the second die, is separated from its corresponding serial data buffer register 139*c* by one interim register 133*c*. Analogously, because the third die is offset from the first die by two scan lines, the output buffer register 141*a* is separated from its corresponding serial data register 149*a* by two interim registers 143*a* and 145*a*.

In general, the registers and nozzles of the printbar circuit 102 are controlled by the printbar control circuit 46 of FIG. 2 or a similar circuit. The printbar control logic 46 controls the sequence of clocking signals to the various registers, and controls the firing sequence of the actual nozzle circuits.

Figure 4:
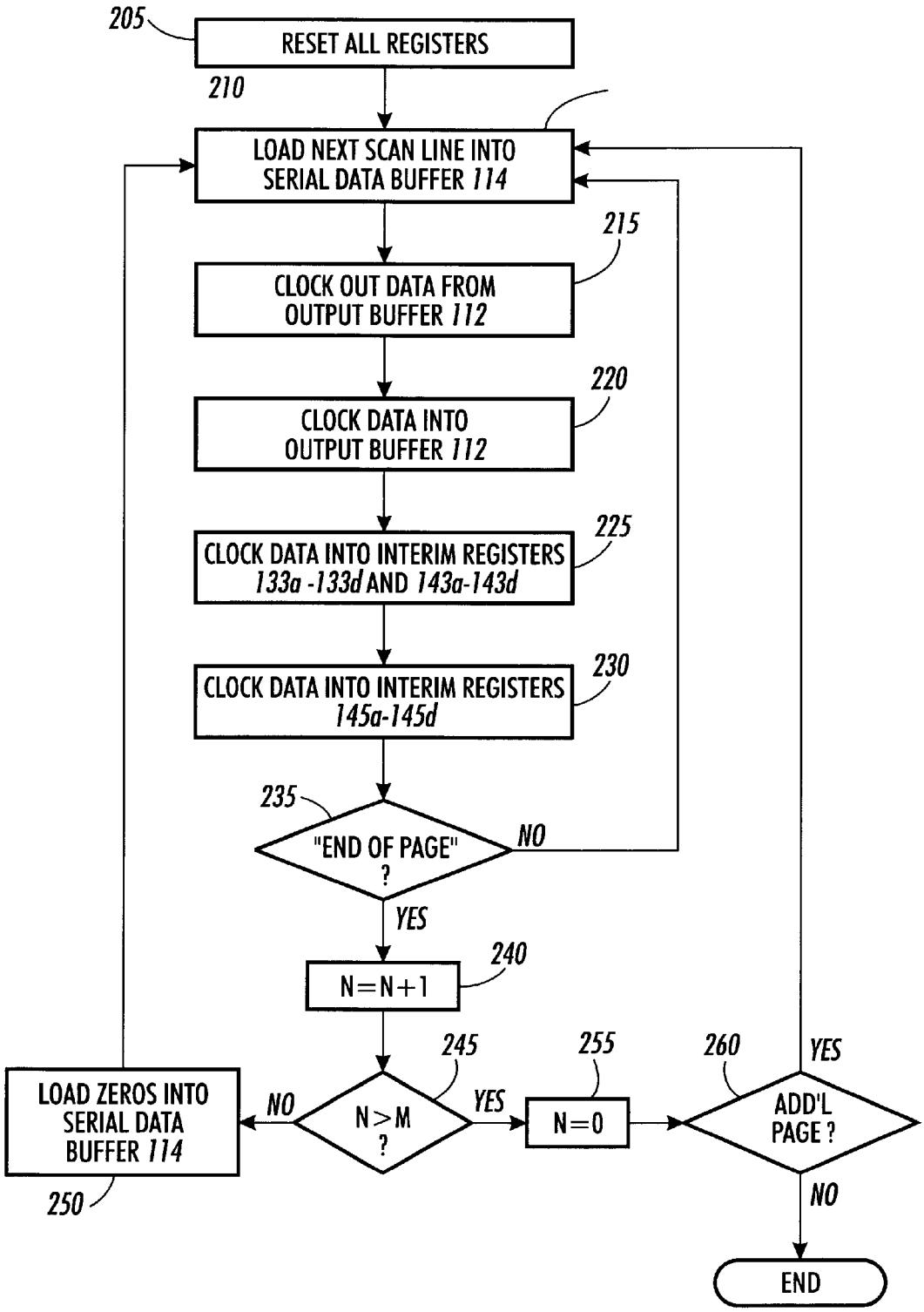
FIG. 4 shows a flow diagram of the operations of the printbar control circuit of the arrangement of FIG. 2.

FIG. 4 shows an exemplary flow diagram of the operation of the printbar control logic 46 of FIG. 2. The printbar control logic 46 may suitably be, alone or in combination, a discrete element logic circuit, an application specific integrated circuit, a gate array, state machine, processor, and/or other device that is operable to carry out the operations described below.

Step 205 represents the beginning of a printing task. In step 205, the printbar control logic 46 first resets all of the registers of the printbar circuit 102, including the registers of the output buffer 112, the serial data buffer 114, and the interim register array 115. The reset operation causes all of the registers to contain a logic zero level. The printbar control logic 46 thereafter proceeds to step 210.

In step 210, the printbar control logic circuit 46 receives the next scan line of data from DMA controller 42. The scan line data is provided serially to the serial data buffer 114 via the first serial data register 129*a*. In the embodiment described herein, the serial data buffer 114 has a sufficient number of registers to receive an entire scan line.

Thereafter, in step 215, the printbar control logic circuit 46 clocks out the data from the output buffer 112 to the nozzle circuits 116*a*–116*d*, 118*a*–118*d*, and 120*a*–120*d*. As a result of step 215, the nozzles expel ink in accordance with the scan line data that is present in the output buffer 112. As discussed further above, the nozzle circuits fire such that the first banks 106*a*, 108*a*, and 110*a* fire simultaneously first. Thereafter, the nozzle circuits 106*b*, 108*b* and 110*b* fire simultaneously. Because of the combined effect of the moving recording medium and the angle offset of the printbar 12, the nozzles corresponding to the first bank 106*a* and the nozzles corresponding to the second bank 106*b* generate a substantially collinear output print on the recording medium. Likewise, the nozzles corresponding to the first bank 108*a* and the nozzles corresponding to the second bank 108*b* generate a substantially collinear output print on the recording medium, as do the nozzles of the first bank 110*a* and the second bank 110*b*. However, the output prints of the first die circuit 106, the second die circuit 108 and the third die circuit 110 are on different scan lines.

It will be noted that steps 210 and 215 need not occur in any particular order with respect to each other. Regardless of what order those steps occur, the result of steps 210 and 215 is that data for a new scan line has been loaded into the serial data buffer 114 and the existing scan line data in the output buffer 112 (which, as will be described below, contains partial data from several scan lines), has been printed out on the recording medium. After step 215, the printbar control logic 46 proceeds to step 220.

In step 220, the printbar control logic 46 clocks new data into the output buffer 112. In particular, the output registers 121*a*–121*d* clock in data from the serial data registers 129*a*–129*d*, respectively; the output registers 131*a*–131*d* clock in data from the serial data registers 133*a*–133*d*, respectively; and the output registers 141*a*–141*d* clock in the data from the serial data registers 143*a*–143*d*, respectively. Thus, in step 220, the next set of data to be printed is clocked into the output buffer 112. The next set of data includes partial scan line data from the serial data registers 121*a*–121*d* and partial scan line data from interim registers 133*a*–133*d* and 143*a*–143*d*.

In steps 225 and 230, the printbar control logic 46 advances data through the interim registers. In particular, in step 225, the printbar control logic 46 clocks data from the serial data registers 139*a*–139*d* into, respectively, the interim registers 133*a*–133*d*. In addition, the printbar control logic 46 clocks data from the interim registers 145*a*–145*d* into, respectively, the interim registers 143*a*–143*d*. In step 230, the printbar control logic circuit 46 clocks data from the serial data registers 149*a*-149 into, respectively, the interim registers 145*a*–145*d*.

After all of the data is clocked through the printbar circuit 102 as described above, the printbar control 46 executes step 235. In step 235, the printbar control logic 46 determines whether the data received from the DMA controller 42 indicates that the next print data is an "end of page" indication, as opposed to another scan line. If not, then the printbar control logic 46 returns to step 210 to receive the next scan line and proceed accordingly. If, however, an end of page is detected, then the printbar control logic 46 proceeds to step 240.

In step 240, the printbar control logic 46 increments a counter N that is representative of the number of passes through the steps 210–230 after the end of page is first detected. As will become evident below, the counter assists in printing out the scan line data stored in the interim register array 115 after the end of page is detected. After step 240, the printbar control logic 46 executes step 245.

In step 245, the printbar control logic circuit 46 determines whether the counter N exceeds a value M, where M is the total number of scan lines that are spanned by the offset of the printbar 12. Accordingly, in the example of FIG. 4, the number M is three.

If however, the printbar control logic circuit 46 determines that the N is not greater than M, then the circuit proceeds to step 250. In step 250, the printbar control logic circuit 46 forces a scan line of all zeros into the serial data buffer 112. The printbar control logic 46 then proceeds to step 215 and proceeds accordingly. The forced zeros allow the interim scan line portions (of die circuits 108 and 110) to be printed even though the nozzles of the first die circuit 106 have passed the last line of the page.

After three passes through step 250, all of the scan line data will have been printed out and the output buffer 112, the serial data buffer 114 and the interim register array 115 are all loaded with zeros. At such point, when the printbar control logic 46 executes step 240, N is incremented to four, which is greater than M.

If N is greater than M, then the scan line data of the previous page as has been completely advanced through the printbar circuit 102. As a result, the printbar control logic 46 proceeds to step 255. In step 255, the printbar control logic 46 resets N and proceeds to step 260. In step 260, the printbar control logic 46 determines whether there are any additional pages. If not, then the printing job is complete and the routine ends. If so, however, then the printbar control logic 46 returns to step 210 to receive data from the next page and proceeds accordingly.

FIGS. 5A through 5D further illustrate the operation of the printbar circuit 102. To this end, FIGS. 5A through 5D show the progression of four scan lines of data L1, L2, L3 and L4 through the various elements of the printbar circuit 102.

Figure 5A:
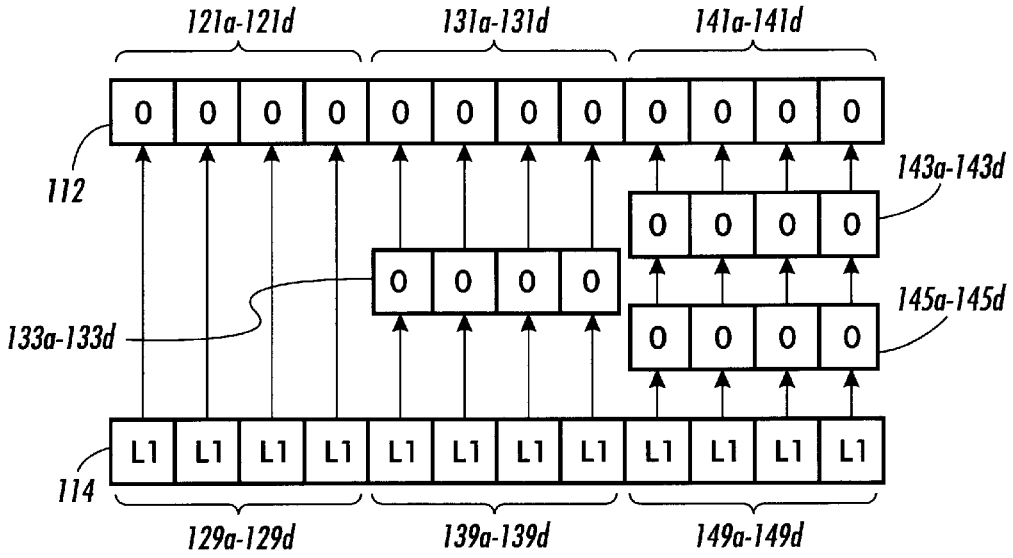
FIGS. 5A, 5B, 5C and 5D show block diagram representations of the progression of scan line data through the printbar circuit of FIG. 3.

In particular, at the beginning of the page (step 205 of FIG. 4), the output buffer 112, the serial data buffer 114, and the interim registers all contain zeros. In step 210, the printbar control logic 46 serial loads the first scan line L1 into the serial data buffer 114. The result of step 210 is shown in FIG. 5A.

In step 215, the printbar control logic 46 clocks out the output buffer 112, which results in no printing because the output buffer 112 contains all zeros. In step 220, 225, and 230 the printbar control logic circuit 46 causes all of the data to be advanced upward one register "tier" towards the output buffer 112. In particular, in step 220, the output registers 121*a*–121*d* receive the L1 scan data from the serial data registers 129*a*–129*d*. The output registers 131*a*–131*d* receive zeros from the adjacent interim registers 133*a*–133*d*, and the output registers 141*a*–141*d* receive zeros from the adjacent interim registers 143*a*–143*d*. In step 225, the interim registers 133*a*–133*d* receive the L1 data from the serial data registers 139*a*–139*d* and the interim registers 143*a*–143*d* receive zeros from the interim registers 145*a*–145*d*. In step 230, the interim registers 145*a*–145*d* receive the L1 data from the serial data registers 149*a*–149*d*.

Figure 5B:
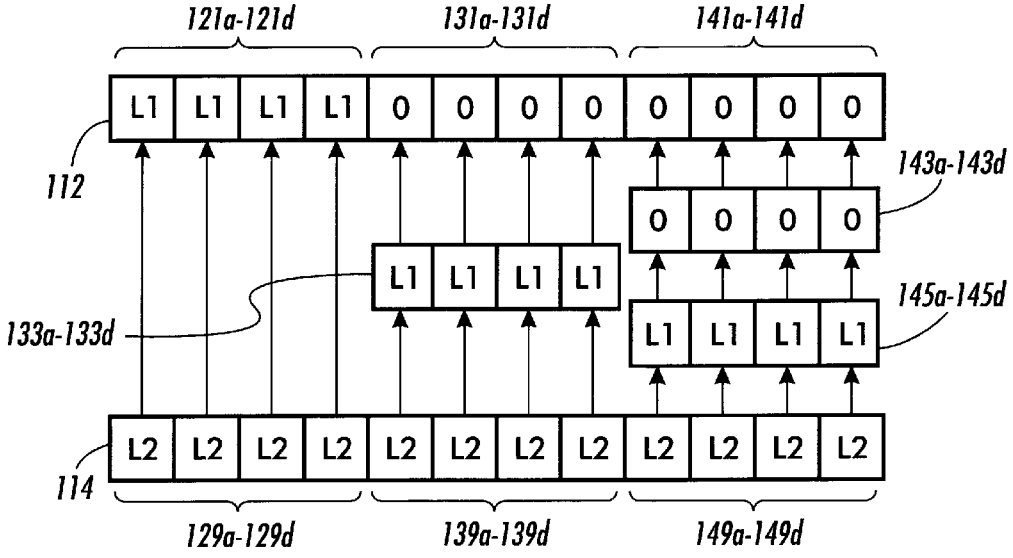

Thereafter, the printbar control logic circuit 46 determines that the end of page has not been reached in step 235 and returns to step 210. In step 210, the printbar control logic 46 serially loads the second scan line L2 into the serial data buffer 114. The result of this execution of step 210, as well as the prior executions of steps 220, 225 and 230, is shown in FIG. 5B.

In the ensuing execution of step 215, the data from the output buffer 112 is printed out. As shown in FIG. 5B, the only scan line data that is printed out is the portion of the L1 scan line data from the output registers 121*a*–121*d* of the first die circuit 106. The limited printing is important because at this point, only the first die is lined up on the first printing line of the recording medium due to the offset configuration of the printbar 12, discussed above. (See also FIG. 1).

In the following steps 220, 225, and 230 the printbar control logic 46 again causes all of the data to be advanced upward one register "tier" towards the output buffer 112. In particular, in step 220, the output registers 121*a*–121*d* receive the L2 scan line data from the serial data registers 129*a*–129*d*. The output registers 131*a*–131*d* receive the L1 scan line data from the adjacent interim registers 133*a*–133*d*, and the output registers 141*a*–141*d* receive zeros from the adjacent interim registers 143*a*–143*d*. In step 225, the interim registers 133*a*–133*d* receive the L2 scan line data from the serial data registers 139*a*–139*d* and the interim registers 143*a*–143*d* receive the L1 scan line data from the interim registers 145*a*–145*d*. In step 230, the interim registers 145*a*–145*d* receive the L2 scan line data from the serial data registers 149*a*–149*d*.

Figure 5C:
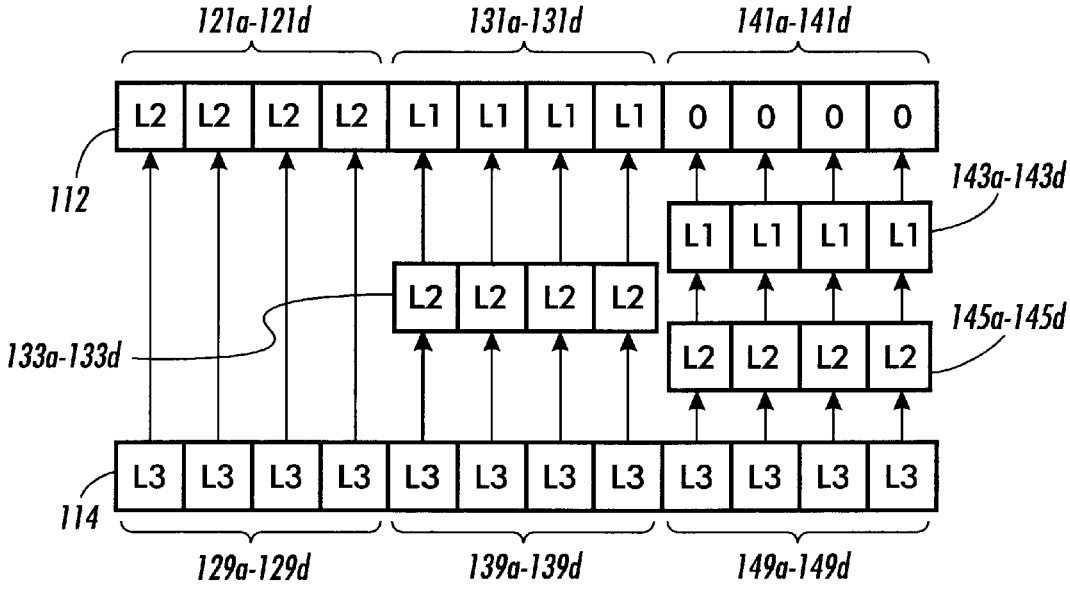

Thereafter, the printbar control logic 46 again determines that the end of page has not been reached in step 235 and returns to step 210. In step 210, the printbar control logic 46 serially loads the third scan line L3 into the serial data buffer 114. The current status of the registers after this execution of step 210 is shown in FIG. 5C.

In the ensuing execution of step 215, the data from the output buffer 112 is printed out. Prior to the printing in step 215, the recording medium is moved in the process direction by one scan line. As shown in FIG. 5C, the only scan line data that is printed out is the portion of the L2 scan line data from the output registers 121*a*–121*d* of the first die circuit 106 and the portion of the L1 scan line data from the output registers 131*a*–131*d* of the second die circuit 108. The L1 scan line data from the output registers 131*a*–131*d* will be collinear with the L1 scan data from the output registers 121*a*–121*d* printed during the previous execution of step 215 because the first die and the second die are spaced apart by one line, and the recording medium has moved one scan line since the previous execution of step 215.

In the following steps 220, 225, and 230 the printbar control logic 46 again causes all of the data to be advanced upward one register "tier" towards the output buffer 112. In particular, in step 220, the output registers 121*a*–121*d* receive the L3 scan line data from the serial data registers 129*a*–129*d*. The output registers 131*a*–131*d* receive the L2 scan line data from the adjacent interim registers 133*a*–133*d*, and the output registers 141*a*–141*d* receive the L1 scan line data from the adjacent interim registers 143*a*–143*d*. In step 225, the interim registers 133*a*–133*d* receive the L3 scan line data from the serial data registers 139*a*–139*d* and the interim registers 143*a*–143*d* receive the L2 scan line data from the interim registers 145*a*–145*d*. In step 230, the interim registers 145*a*–145*d* receive the L3 scan line data from the serial data registers 149*a*–149*d*.

Figure 5D:
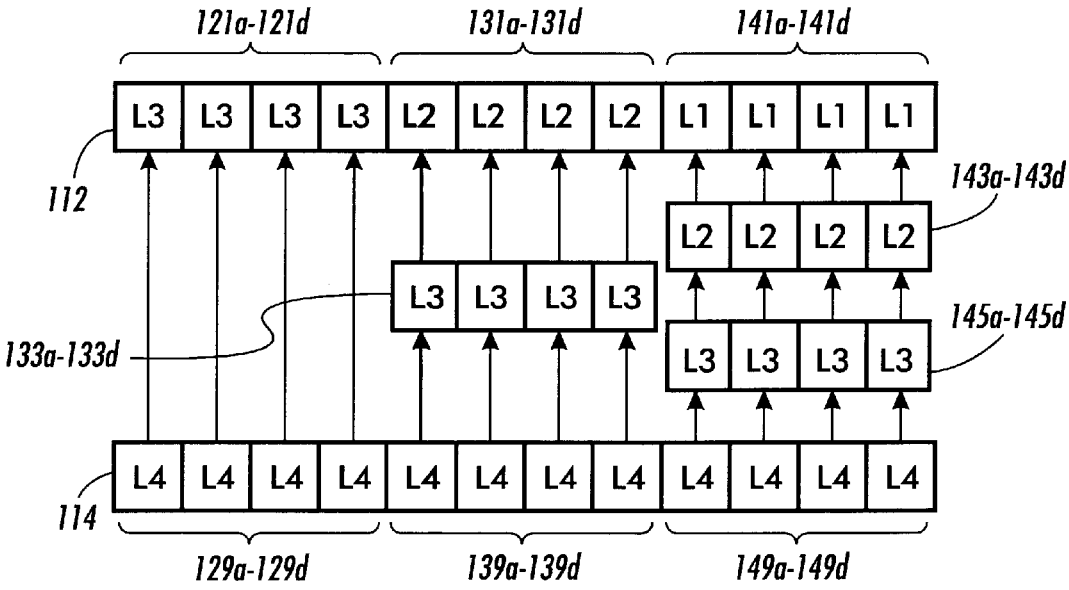

Thereafter, the printbar control logic 46 again determines that the end of page has not been reached in step 235 and returns to step 210. In step 210, the printbar control logic 46 serially loads the fourth scan line L4 into the serial data buffer 114. The current status of the registers after this execution of step 210 is shown in FIG. 5D.

In the ensuing execution of step 215, the data from the output buffer 112 is printed out. Prior to the printing in step 215, the recording medium is again moved in the process direction by one scan line. As shown in FIG. 5D, the scan line data that is printed out consists of the portion of the L3 scan line data from the output registers 121*a*–121*d* of the first die circuit 106, the portion of the L2 scan line data from the output registers 131*a*–131*d* of the second die circuit 108, and the portion of the L1 scan line data from the output registers 141*a*–141*d* of the third die circuit 110. The L1 scan line data from the output registers 141*a*–141*d* will be collinear with the L1 scan line data printed during prior executions of step 215. Likewise, the L2 scan line data from the output registers 131*a*–131*d* will be collinear with the L2 scan line data from the output registers 131*a*–131*b* printed on the previous execution of step 215.

The printbar control logic 46 thereafter continues through the flow diagram as discussed above in connection with the general description of FIG. 4.

As will be appreciated by the above described operation, the use of interim registers in the printbar circuit 102 allows the printbar circuit 102 to receive serial scan line data even when the entire printbar 12 is tilted such that each print die prints on a separate scan line. As discussed above, the tilting of the printbar 102 is advantageous because it allows the banks of each die to be fired sequentially while the recording medium is moving the process direction without significant skew due to such movement. The entire printbar 12 is tilted because of manufacturing concerns with attempting to tilt the individual print dies.

One alternative embodiment envisions overcoming the manufacturing concerns associated with tilting individual print dies. In such an embodiment, shown in FIG. 6, the printbar 312 is not tilted, but instead the individual print die 318 are tilted at the same angle. As a result, the first nozzle of each of the individual print dies is substantially aligned along a line that is normal to the process direction 16.

The firing sequence of the banks of nozzles is identical to that described above in connection with the first embodiment. In particular, the banks of each die are fired in sequence, such that the same bank from all of the dies fire simultaneously. For example, the first banks of the print dies all fire simultaneously, followed by the simultaneous firing of the second banks of all of the print dies, and so forth. Because the dies are tilted, the sequential firing of banks of nozzles against the moving recording medium results in each die printing in substantial collinear alignment.

It is noted that in the embodiment of FIG. 6, the interim register array 115 would not be required. Instead, each serial data register of the serial data buffer 114 would be directly connected to provide data to the output buffer 112. The printbar control logic 46 would load the serial data buffer 114 with the next scan line at or about the same time that the nozzle circuits are printing the data from the output buffer 112.

It is noted that other embodiments may not include all of the features described herein yet still benefit from at least some of the advantages of the invention. Those of ordinary skill in the art may readily devise their own such implementations that incorporate one or more of the features of the present invention and fall within the spirit and scope thereof.

What is claimed is:

1. An arrangement for printing a raster image organized into a plurality of scan lines on a recording medium, the arrangement comprising:

a memory containing scan line data representative of at least one of said scan lines; and a printbar comprising a plurality of nozzles and a printbar circuit, the printbar circuit including an output buffer and a serial data buffer; the serial data buffer including a serial data register corresponding to each nozzle, the serial data buffer operably connected to receive serially the scan line data such that the serial data buffer includes scan line data corresponding to a first scan line, the output buffer including an output register corresponding to each nozzle, the output buffer operably connected to receive the scan line data from the serial data buffer, the printbar circuit operable to cause the plurality of nozzles to print on the recording medium in accordance with the scan line data stored in the output buffer while the recording medium moves continuously in a process direction and wherein the printbar further comprises a first number of buffer registers interposed between the serial data register and the output register corresponding to a first nozzle, and a second number of buffer registers interposed between the serial data register and the output register corresponding to a second nozzle, the second number greater than the first number.

2. The arrangement of claim 1 wherein the plurality of nozzles includes at least a first set of nozzles and wherein the serial data register and the output register corresponding to each nozzle of the first set of nozzles are directly connected.

3. The arrangement of claim 1 wherein the plurality of nozzles correspond to a first color of a multicolor printbar.

4. The arrangement of claim 1 wherein:

the plurality of nozzles are arranged in a plurality of dies, the plurality of dies composed of a plurality of banks; each bank of each die including at least one nozzle;

the printbar circuit is operable to cause a first set of nozzles to print contemporaneously, the first set of nozzles including the nozzles of a first bank of each of the plurality of dies; and the printbar circuit is operable to cause a second set of nozzles to print contemporaneously, the second set of nozzles including the nozzles of a second bank of each of the plurality of dies.

5. The arrangement of claim 4 wherein the first bank of nozzles of a first die are configured to print a portion of the first scan line data and the first bank of nozzles of a second die are configured to print a portion of second scan line data contemporaneously.

6. The arrangement of claim 1 wherein the first number is zero.

7. The arrangement of claim 1 wherein the printbar comprises a full width array printbar.

8. The arrangement of claim 1 wherein the printbar includes a plurality of dies, each die including a set of nozzles.

9. The arrangement of claim 8 wherein each die is tilted with respect to the plurality of scan lines.

10. A method for printing a raster image organized into a plurality of scan lines on a recording medium, the method comprising:

storing scan line data representative of said scan lines in a memory;

providing the scan line data serially to a serial data buffer such that the serial data buffer includes scan line data corresponding to a first scan line, the serial data buffer including a serial data register corresponding to each nozzle;

transferring less than all of the scan line data corresponding to the first scan line directly from the serial data buffer to an output buffer, the output buffer including an output register corresponding to each nozzle, said transferring comprising transferring the scan line data directly between each serial data register and each output buffer corresponding to each nozzle; and causing a plurality of nozzles to print on the recording medium in accordance with the scan line data stored in the output buffer.

11. The method of claim 10, wherein the plurality of nozzles are arranged in a plurality of dies, the plurality of dies composed of a plurality of banks, each bank of each die including at least one nozzle, and wherein causing the plurality of nozzles to print on the recording medium further comprises:

causing a first set of nozzles to print contemporaneously, the first set of nozzles including the nozzles of a first bank of each of the plurality of dies; and causing a second set of nozzles to print contemporaneously, the second set of nozzles including the nozzles of a second bank of each of the plurality of dies.

12. The method of claim 11, further comprising:

causing the first bank of nozzles of a first die to print a portion of the first scan line data and the first bank of nozzles of a second die to print a portion of second scan line data contemporaneously.

13. The method of claim 10 further comprising transferring a portion of the scan line data corresponding to the first scan line in the serial data buffer to an intermediate buffer disposed between the serial data buffer and the output buffer.

14. The method of claim 13 further comprising transferring data from a second scan line from an intermediate buffer to the output buffer contemporaneously with transferring less than all of the scan line data corresponding to the first scan line from the serial data buffer to an output buffer.

15. The method of claim 10 further comprising transferring data from a second scan line from an intermediate buffer to the output buffer contemporaneously with transferring less than all of the scan line data corresponding to the first scan line from the serial data buffer to an output buffer.

16. A full width printbar circuit for use in a printbar that contains a plurality of nozzles for depositing ink onto a recording medium, the printbar circuit comprising:

a serial data buffer operably connected to receive serially the scan line data for a scan line of print data, the scan line of print data corresponding to a line to be printed on the recording medium, the serial data buffer including a serial data register corresponding to each nozzle, an output buffer operably connected to receive the scan line data from the serial data buffer, the output buffer including an output register corresponding to each nozzle, at least one intermediate buffer interposed between the serial data register and the output register corresponding to at least one nozzle, a plurality of nozzle circuits operable to cause the plurality of nozzles to print on the recording medium in accordance with the scan line data stored in the output buffer when the recording medium continuously moves in a process direction.

17. The arrangement of claim 16 wherein:

the plurality of nozzles are arranged in a plurality of dies, the plurality of dies composed of a plurality of banks; each bank of each die including at least one nozzle;

the printbar circuit is operable to cause a first set of nozzles to print contemporaneously, the first set of nozzles including the nozzles of a first bank of each of the plurality of dies; and the printbar circuit is operable to cause a second set of nozzles to print contemporaneously, the second set of nozzles including the nozzles of a second bank of each of the plurality of dies.

* * * * *